US006883800B2

(12) United States Patent
Mizuno

(10) Patent No.: US 6,883,800 B2
(45) Date of Patent: Apr. 26, 2005

(54) PAPER CONVEY METHOD AND DEVICE IN IMAGE FORMING APPARATUS

(75) Inventor: Masanaka Mizuno, Mishima (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 71 days.

(21) Appl. No.: 10/369,134

(22) Filed: Feb. 20, 2003

(65) Prior Publication Data

US 2004/0164484 A1 Aug. 26, 2004

(51) Int. Cl.[7] ..... B65H 5/34
(52) U.S. Cl. ..... 271/270; 271/902
(58) Field of Search ..... 271/902, 270

(56) References Cited

U.S. PATENT DOCUMENTS 5,957,450 A * 9/1999 Kida et al. ..... 271/291
6,681,096 B1 * 1/2004 Seto et al. ..... 399/388
2003/0062671 A1 * 4/2003 Yasui et al. ..... 271/270

FOREIGN PATENT DOCUMENTS

JP 11-059965 3/1999
JP 2001-240285 9/2001

* cited by examiner

*Primary Examiner*—Donald P Walsh
*Assistant Examiner*—Kenneth W Bower
(74) *Attorney, Agent, or Firm*—Foley & Lardner LLP

(57) ABSTRACT

In a paper convey method and device in an image forming apparatus according to this invention, a first sensor detects that the first paper sheet is fed from a paper feed unit, and a CPU outputs a control signal defining a desired cycle time at which paper sheets should be conveyed. A second sensor then detects the timing at which each paper sheet passes near a reverse motor in a reverse/paper discharge unit. The same or another CPU compares the timing of the passage of each paper sheet with the cycle time defined by the control signal and determines a delay or advance for each paper sheet. The desire cycle time is realized by controlling the reverse motor and a paper discharge motor in accordance with the determination result.

6 Claims, 3 Drawing Sheets

PAPER CONVEY METHOD AND DEVICE IN IMAGE FORMING APPARATUS

BACKGROUND OF THE INVENTION

An image forming apparatus such as a printer or copying machine has a device for conveying a paper sheet to discharge it after an image is formed thereon. In some cases, however, the timing of feeding paper sheets varies to result in variations in the intervals between the respective paper sheets when they are discharged.

Japanese Patent Laid-Open No. 11-59965 discloses a technique of detecting variations in paper sheet intervals, expected to occur at the time of paper feed, at a transfer unit, and automatically correcting them to bring the paper sheet intervals near to desired paper sheet intervals.

Japanese Patent Laid-Open No. 2001-240285 discloses a technique of preventing the occurrence of a conveyance error such as a jam by detecting the interval between paper sheets on a reverse route, when each paper sheet is reversed and discharged to be registered, and correcting the interval to a predetermined value.

In the above technique of detecting the intervals of paper sheets, a reflection type photosensor and a sensor for detecting the presence/absence of a paper sheet that passes are used to detect the interval between the trailing end of a preceding paper sheet and the leading end of a succeeding paper sheet, and the motor is controlled to change the convey speed, thereby bringing the interval to a desired interval.

According to this technique, the intervals between paper sheets can be corrected by detecting the intervals of the respective paper sheets and changing the convey speed of paper sheets. If, however, the interval between paper sheets deviates, since the convey speed of subsequent paper sheets is changed, the intervals between the respective paper sheets deviate after the change in convey speed. More specifically, if the interval between the jth (j is an arbitrary positive number) paper sheet and the (j+1)th paper sheet is shorter than a desired interval, the convey speed of the (j+1)th paper sheet must be decreased to increase this interval. Even if, however, the interval between the (j+1)th paper sheet and the (j+2)th paper sheet has been normal before this control, this interval decreases after the control. This time, therefore, the convey speed of the (j+2) th paper sheet must be decreased. As described above, once the interval between any two paper sheets deviates, the convey speeds of the succeeding paper sheets must be changed, resulting in complicated control.

SUMMARY OF THE INVENTION

The present invention has been made in consideration of the above situation, and has as its object to provide a paper convey method and device in an image forming apparatus which can correct the intervals between paper sheets by simple control.

According to the present invention, there is provided a paper convey device in an image forming apparatus, comprising:

- a paper feed unit which feeds a paper sheet;
- a first sensor which is placed near an exit of the paper feed unit, detects passage of a first paper sheet, and outputs a first detection signal;
- a first CPU which receives the first detection signal to generate a control signal defining a desired cycle time at which the respective paper sheets should be conveyed;

- a reverse/paper discharge unit which, upon reception of the paper sheet, reverses a direction of a paper sheet by using a reverse motor, and discharges the paper sheet by using a paper discharge motor;
- a second sensor which is placed near the reverse motor in the reverse/discharge unit, detects passage of each paper sheet, and outputs a second detection signal, and
- a second CPU which receives the control signal and the second detection signal, compares a timing of passage of each paper sheet with the cycle time defined by the control signal, determines a delay or an advance for each paper sheet, and controls the reverse motor in accordance with the determination result.

In this device, the first and second CPUs may be the same. In addition, the second CPU may control not only the reverse motor but also the paper discharge motor in accordance with the determination result.

According to the present invention, there is provided a paper convey method of conveying a paper sheet in an image forming apparatus, comprising:

- the step of detecting that a first paper sheet is fed from a paper feed unit;
- the step of, when feeding of the first paper sheet is detected, generating a control signal defining a desired cycle time at which the respective paper sheets should be conveyed;
- the step of, when each paper sheet is fed, detecting a timing at which the paper sheet passes near an entrance of a reverse unit of a reverse/paper discharge unit which reverses a direction of the paper sheet by using a reverse motor and discharges the paper sheet; and
- the step of comparing the timing at which each of the paper sheets passes with the cycle time defined by the control signal, determining a delay or an advance for each paper sheet, and controlling the reverse motor in accordance with the determination result.

According to the present invention, there is provided a paper convey method of conveying a paper sheet in an image forming apparatus, comprising:

- the step of, when a paper sheet is fed from a paper feed unit, causing a first sensor placed near an exit of the paper feed unit to detect that a first paper sheet is fed;
- the step of, when feeding of the first paper sheet is detected, causing a first CPU to output a control signal defining a desired cycle time at which the respective paper sheets should be conveyed;
- the step of, when each paper sheet is fed, causing a second sensor placed near a reverse motor to detect a timing at which the paper sheet passes in a reverse/paper discharge unit which reverses a direction of the paper sheet by using the reverse motor and discharges the paper sheet by using a discharge motor; and
- the step of causing a second CPU to compare the timing at which each of the paper sheets passes with the cycle time defined by the control signal, determine a delay or an advance for each paper sheet, and control the reverse motor and the paper discharge motor in accordance with the determination result.

DESCRIPTION OF THE PREFERRED EMBODIMENT

An embodiment of the present invention will be described below with reference to the accompanying drawings.

Figure 1:
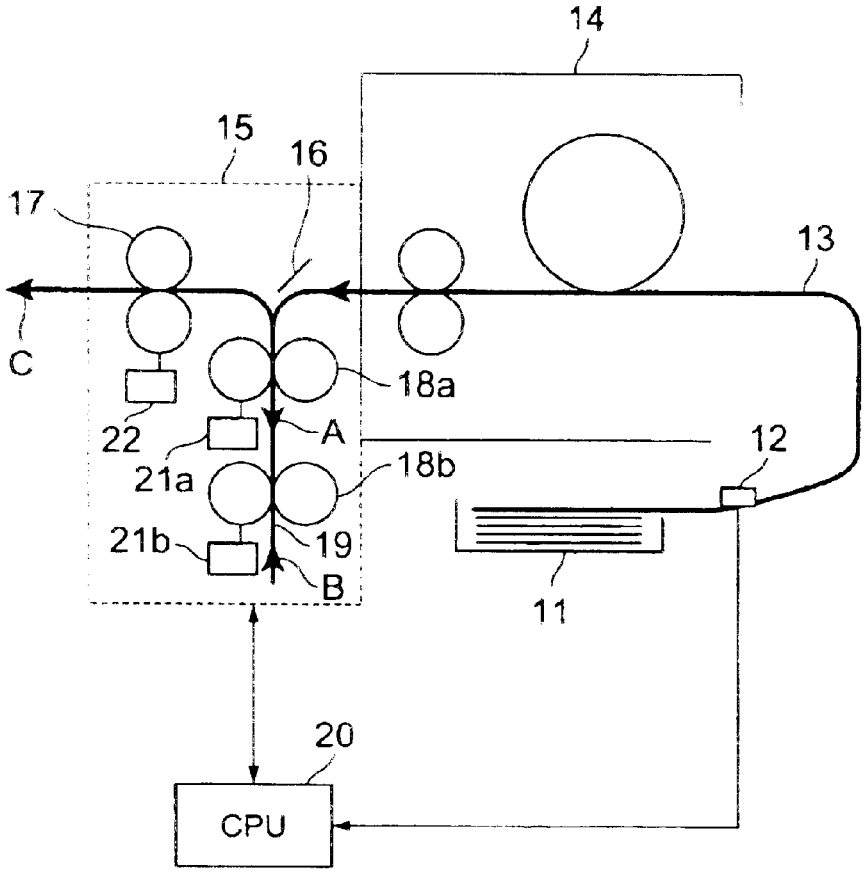
FIG. 1 is a view showing the schematic arrangement of a paper convey device in an image forming apparatus according to an embodiment of the present invention.

FIG. 1 shows the schematic arrangement of a paper convey device in an image forming apparatus according to this embodiment.

A paper sheet is fed from a paper feed unit 11 including a paper feed cassette in which paper sheets are stored to the image forming apparatus.

When the paper sheet is fed from the paper feed unit 11 to a convey path 13, a paper sensor 12 placed near the exit of the paper feed unit 11 detects the leading end of the first paper sheet and outputs a detection signal to a CPU 20. With this operation, the CPU 20 recognizes that the first paper sheet has passed, and generates a control signal like the shown in FIG. 2.

This control signal has a waveform that rises to high level at intervals (for example, 740 msec at 81 cpm) at which the leading ends of the first, second, third, and subsequent paper sheets should pass.

An image is formed on the fed paper sheet by a developing unit (not shown) while being conveyed on the convey path 13. The image is then fixed by a fixing unit 14.

The paper sheet output from the fixing unit 14 is reversed by a reverse/paper discharge unit 15 and then discharged to an external unit (e.g., a finisher).

In the reverse/paper discharge unit 15, a sensor 16 such as a gate solenoid placed near the entrance of the reverse unit detects the leading end of each paper sheet immediately before it is reversed. Every time the sensor 16 detects the passage of a paper sheet, the CPU 20 is notified of the corresponding information.

The paper sheet is fed first in the direction indicated by an arrow A by reverse motors 18*a* and 18*b* and then reversed and fed in the direction indicated by an arrow B. Thereafter, the paper sheet is discharged in the direction indicated by an arrow C by a paper discharge motor 17.

Figure 2:
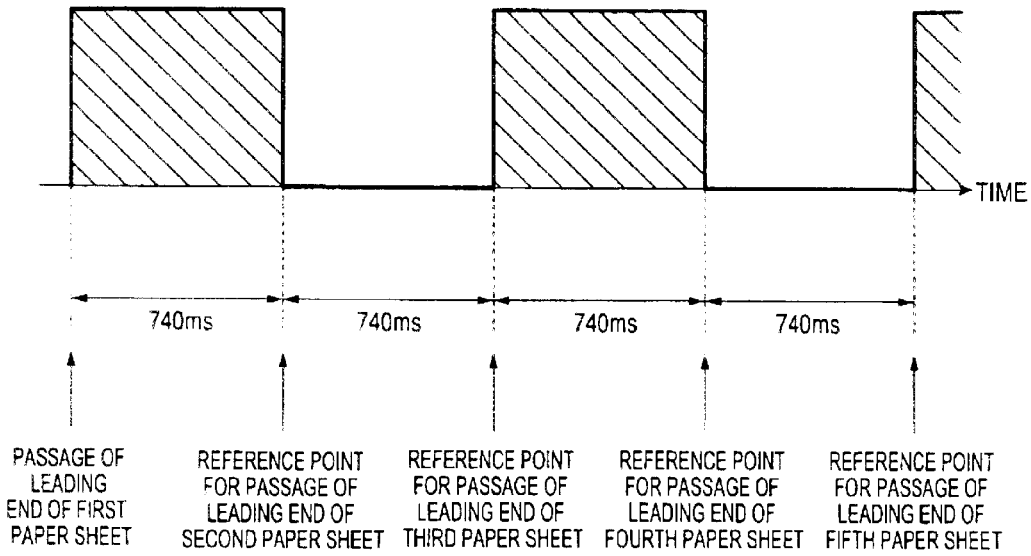
FIG. 2 is a timing chart showing the waveform of a convey control signal output from a CPU in the paper convey device.

The CPU 20 compares the cycle of the control signal shown in FIG. 2, i.e., the desired paper sheet intervals, with the cycle detected by the sensor 16, i.e., the intervals between the respective paper sheets, and detects a deviation for each paper sheet. If a paper sheet is fed earlier than a desired interval, rotation control is performed for motor drivers 21*a* and 21*b* for driving the reverse motors 18*a* and 18*b* and a motor driver 22 for driving the paper discharge motor 17 so as to decrease the convey speed. In contrast, if a paper sheet is fed later than the desired interval, rotation control is performed for the motor drivers 21*a* and 21*b* for driving the reverse motors 18*a* and 18*b* and the motor driver 22 for driving the paper discharge motor 17 so as to increase the convey speed.

As described above, in this embodiment, when the paper sensor 12 detects the leading end of the first paper sheet fed from the paper feed unit 11, the convey speed of the subsequent paper sheets is controlled with reference to this detection, unlike in the prior art wherein the intervals between consecutive paper sheets are controlled. When the paper sensor 12 detects the first paper sheet, the CPU 20 generates a control signal indicating a cycle time required to realize a desired convey speed. The CPU 20 compares the desired cycle time defined by this control signal with the timing of the passage of each paper sheet which is detected by the sensor 16 of the reverse/paper discharge unit 15, and determines a delay or advance, thereby controlling the reverse motors 18*a* and 18*b* and paper discharge motor 17.

Unlike in the conventional control method of controlling the intervals between paper sheets constant, in this method, even when the intervals between paper sheets deviate, an adjustment can be easily made by a simple control technique without any influence on the intervals between the subsequent paper sheets.

In this case, a certain period of time is required for the CPU 20 to compare a control signal with the passage of each paper sheet detected by the sensor 16 and control the motors. However, it takes time to cause the reverse/paper discharge unit 15 to reverse each paper sheet after the first paper sheet is fed, and hence there is a sufficient time for control. Therefore, the motors can be controlled without any trouble.

Figure 3:
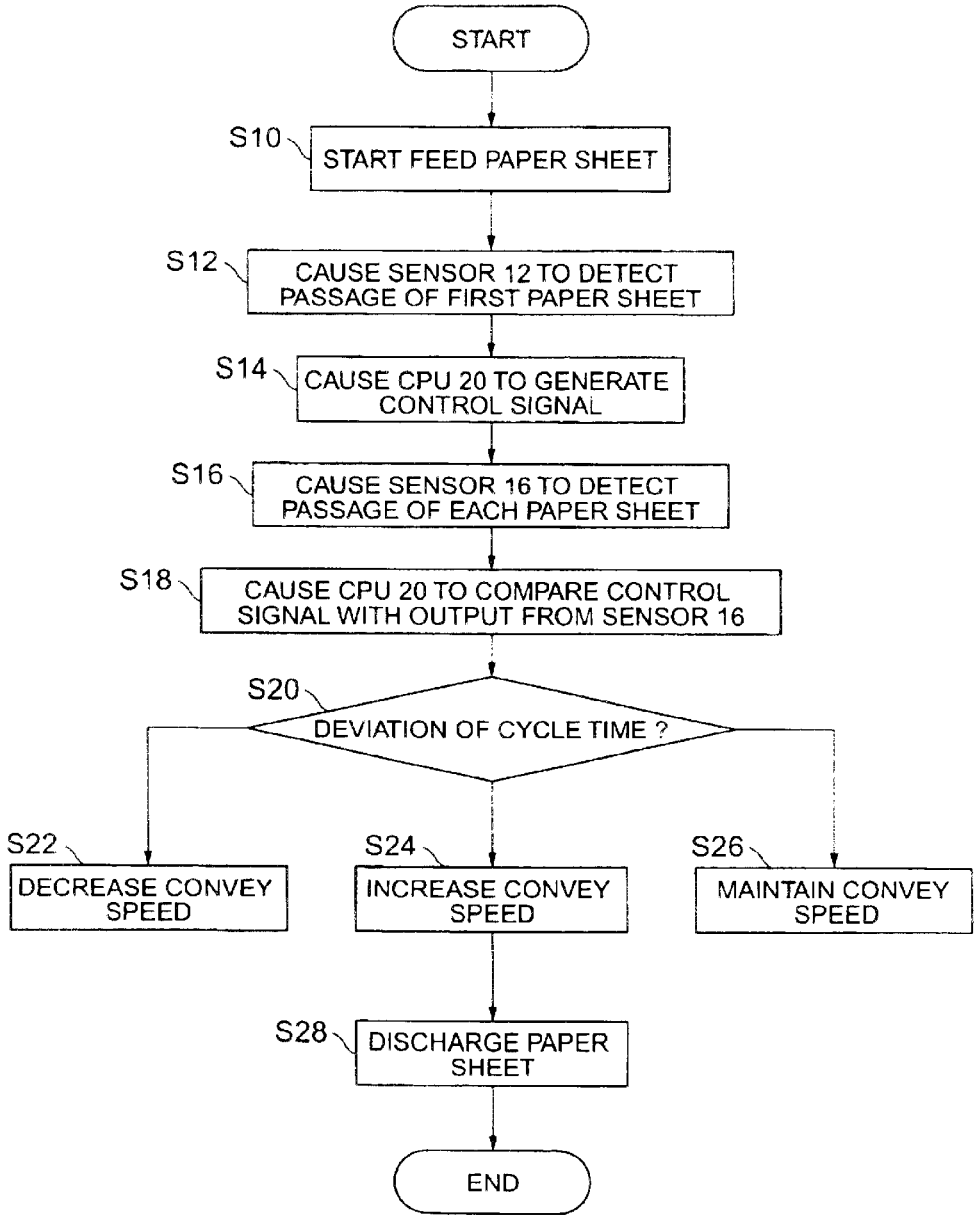
FIG. 3 is a flow chart showing a control procedure for reverse/paper discharge speed in the paper convey device.

FIG. 3 shows a procedure for necessary processing in the above convey control.

Assume that the user has selected the consecutive paper feed mode and the reverse mode as a sort mode.

In step S10, paper feed is started from the paper feed unit 11.

In step S12, the paper sensor 12 placed near the exit of the paper feed unit 11 detects the leading end of the first paper sheet and outputs a detection signal to the CPU 20. This sensor 12 has, for example, a switch that turns on or off in accordance with the presence/absence of a paper sheet.

In step S14, the CPU 20 receives this detection signal and generates a control signal by computing a cycle time at which the respective paper sheets should pass in order to realize a desired convey path on the basis of the conditions designated by the user and the like.

When the paper sheet is conveyed to the reverse/paper discharge unit 15 afterward, since the sort mode has been selected by the user, the sensor 16 placed near the entrance of the reverse motor 18*a* detects the passage of each paper sheet and outputs a detection signal in step S16.

Each paper sheet is then conveyed to the reverse route by the reverse motors 18*a* and 18*b*.

In step S18, the CPU 20 compares the desired cycle time indicated by the control signal generated by the CPU 20 with the timing of the passage of each paper sheet detected by the sensor 16. In step S20, the CPU 20 determines a cycle time deviation. If the paper sheet passes earlier than the desired cycle time, the flow advances to step S22 to control the motor drivers 21*a* and 21*b* and motor driver 22 so as to decrease the convey speed based on the reverse motors 18*a* and 18*b* and paper discharge motor 17.

If the paper sheet passes later than the desired cycle time, the flow advances to step S24 to control the motor drivers 21*a* and 21*b* and motor driver 22 so as to increase the convey speed based on the reverse motors 18*a* and 18*b* and paper discharge motor 17.

If the timing at which the paper sheet passes coincides with the desired cycle time, the flow advances to step S26 to control the motor drivers 21*a* and 21*b* and motor driver 22 so as to maintain the convey speed based on the reverse motors 18*a* and 18*b* and paper discharge motor 17.

After the convey speed is controlled at the reverse/paper discharge unit 15 so as to realize the desired cycle time in this manner, each paper sheet is discharged from the paper discharge unit in step S28.

As described above, when the first paper sheet is fed, the paper sheet is detected, and the CPU calculates a desired cycle time with reference to this detection. The CPU then compares the timing of the passage of each paper sheet with the desired cycle time generated by the CPU to determine a deviation of the timing of the passage of each paper sheet, thereby performing control operation. This therefore eliminates the necessity to perform control so as to always maintain the interval between the jth paper sheet and the (j+1)th paper sheet constant.

The above embodiment is only an example. The present invention is not limited to this and can be variously modified within the technical range defined by the appended claims. For example, the above embodiment has been described by exemplifying a system copy speed of 81 cpm, at which images are formed on 81 paper sheets per minute. However, the present invention is not limited to this speed and can be applied to any speeds.

In the above embodiment, one CPU 20 serves both as a CPU for generating a control signal defining a desired cycle time upon being notified of the detection of the leading end of the first paper sheet detected by the sensor 12 near the exit of the paper feed unit 11, and a CPU for comparing the control signal with the timing of the passage of each paper sheet detected by the sensor 16 near the entrance of the reverse unit. However, different CPUs may be provided for the respective operations.

In addition, in the above embodiment, in order to realize a desired cycle time, the reverse motors 18*a* and 18*b* and paper discharge motor 17 are controlled. However, only the reverse motors 18*a* and 18*b* maybe controlled, although it is preferable to control the paper discharge motor 17 as well as the reverse motors 18*a* and 18*b* in order to control the convey speed more smoothly with higher precision.

What is claimed is:

1. A paper convey device for conveying a paper sheet in an image forming apparatus, comprising:

a paper feed unit which feeds a paper sheet;

a first sensor which is placed near an exit of said paper feed unit, detects passage of a first paper sheet, and outputs a first detection signal;

a first CPU which receives the first detection signal to generate a control signal defining a desired cycle time at which the respective paper sheets should be conveyed;

a reverse/paper discharge unit which, upon reception of the paper sheet, reverses a direction of a paper sheet by using a reverse motor, and discharges the paper sheet by using a paper discharge motor;

a second sensor which is placed near the reverse motor in said reverse/discharge unit, detects passage of each paper sheet, and outputs a second detection signal, and a second CPU which receives the control signal and the second detection signal, compares a timing of passage of each paper sheet with the cycle time defined by the control signal, determines a delay or an advance for each paper sheet, and controls the reverse motor in accordance with the determination result.

2. A device according to claim 1, wherein said first and second CPUs are the same.

3. A device according to claim 1, wherein said second CPU controls the reverse motor and the paper discharge motor in accordance with the determination result.

4. A device according to claim 2, wherein said second CPU controls the reverse motor and the paper discharge motor in accordance with the determination result.

5. A paper convey method of conveying a paper sheet in an image forming apparatus, comprising:

the step of detecting that a first paper sheet is fed from a paper feed unit;

the step of, when feeding of the first paper sheet is detected, generating a control signal defining a desired cycle time at which the respective paper sheets should be conveyed;

the step of, when each paper sheet is fed, detecting a timing at which the paper sheet passes near an entrance of a reverse unit of a reverse/paper discharge unit which reverses a direction of the paper sheet by using a reverse motor and discharges the paper sheet; and the step of comparing the timing at which each of the paper sheets passes with the cycle time defined by the control signal, determining a delay or an advance for each paper sheet, and controlling the reverse motor in accordance with the determination result.

6. A paper convey method of conveying a paper sheet in an image forming apparatus, comprising:

the step of, when a paper sheet is fed from a paper feed unit, causing a first sensor placed near an exit of the paper feed unit to detect that a first paper sheet is fed;

the step of, when feeding of the first paper sheet is detected, causing a first CPU to output a control signal defining a desired cycle time at which the respective paper sheets should be conveyed;

the step of, when each paper sheet is fed, causing a second sensor placed near a reverse motor to detect a timing at which the paper sheet passes in a reverse/paper discharge unit which reverses a direction of the paper sheet by using the reverse motor and discharges the paper sheet by using a discharge motor; and the step of causing a second CPU to compare the timing at which each of the paper sheets passes with the cycle time defined by the control signal, determine a delay or an advance for each paper sheet, and control the reverse motor and the paper discharge motor in accordance with the determination result.

* * * * *